US006477780B2

(12) United States Patent
Aldred

(10) Patent No.: US 6,477,780 B2
(45) Date of Patent: Nov. 12, 2002

(54) ARCHERY BOW SIGHT

(76) Inventor: Robert C. Aldred, 1209 E. 7th St., Kewanee, IL (US) 61443

( * ) Notice: Subject to any disclaimer, the term of this patent is extended or adjusted under 35 U.S.C. 154(b) by 21 days.

(21) Appl. No.: 09/747,896

(22) Filed: Dec. 26, 2000

(65) Prior Publication Data

US 2002/0078577 A1 Jun. 27, 2002

(51) Int. Cl.[7] ..... F41G 1/467
(52) U.S. Cl. ..... 33/265; 124/87; 42/123
(58) Field of Search ..... 33/265, 276; 42/123, 42/132

(56) References Cited

U.S. PATENT DOCUMENTS

| | | | | | |
|---|---|---|---|---|---|
| D260,417 | S | | 8/1981 | Siekman | |
| 4,977,678 | A | | 12/1990 | Sears | |
| 5,001,837 | A | | 3/1991 | Bray | |
| 5,092,052 | A | | 3/1992 | Godsey | |
| 5,103,568 | A | * | 4/1992 | Canoy | 42/132 |
| 5,341,791 | A | | 8/1994 | Shafer | |
| 5,414,936 | A | * | 5/1995 | Sappington | 33/265 |
| 5,685,081 | A | * | 11/1997 | Winegar | 33/265 |
| 5,791,060 | A | * | 8/1998 | Godsey | 33/265 |
| 6,082,012 | A | * | 7/2000 | McLeod | 42/132 |
| 6,311,405 | B1 | * | 11/2001 | Slates | 42/132 |
| 6,336,285 | B1 | * | 1/2002 | Baumer | 42/123 |

* cited by examiner

*Primary Examiner*—Diego Gutierrez
*Assistant Examiner*—Yaritza Guadalupe
(74) *Attorney, Agent, or Firm*—Kaardal & Leonard, LLP

(57) ABSTRACT

A archery bow sight for facilitating the user's ability to focus on the target and the aiming pin at the same time without losing focus on either subject. The archery bow sight includes a sight tube for viewing into by the dominant eye of the user. The sight tube is elongate, with a first end for orienting toward a user and a second end being for orienting toward a target. The sight tube comprises a perimeter wall defining a lumen extending between the first and second ends of the sight tube. A light pin assembly is provided for creating a point of light on a light tip in the lumen being viewable through the first end of the sight tube for aligning with a targe. The second end of the lumen of the sight tube is substantially entirely closed against light transmission therethrough for preventing light transmission through the second end of the sight tube.

20 Claims, 4 Drawing Sheets

ARCHERY BOW SIGHT

BACKGROUND OF THE INVENTION

1. Field of the Invention

The present invention relates to aiming sights and more particularly pertains to a new archery bow sight for facilitating the user's ability to focus on the target and the aiming pin at the same time without losing focus on either subject.

2. Description of the Prior Art

The use of aiming sights is known in the prior art. Sights have been devised for aiming weapons, such as archery bows, at targets. These known sights have typically required the user of the sight to use only his or her dominant eye to focus on both a near pin (mounted on the sight) and a distant target, and visually align the pin and the targets while keeping these items in focus. The user often finds it difficult to simultaneously clearly focus on the near pin and the distant target in a way that permits an accurate and repeatable alignment of the pin and target. This difficulty can result in the user not noticing that the target has moved until after firing the weapon. The known aiming sights also tend to be complex and relatively expensive.

The archery bow sight according to the present invention substantially departs from the conventional concepts and designs of the prior art, and in so doing provides an apparatus primarily developed for the purpose of facilitating the user's ability to focus on the target and the aiming pin at the same time without losing focus on either subject.

SUMMARY OF THE INVENTION

In view of the foregoing disadvantages inherent in the known types of aiming sights now present in the prior art, the present invention provides a new archery bow sight construction wherein the same can be utilized for facilitating the user's ability to focus on the target and the aiming pin at the same time without losing focus on either subject.

The present invention generally comprises a sight tube for viewing into by the dominant eye of the user. The sight tube is elongate, with a first end for orienting toward a user and a second end being for orienting toward a target. The sight tube comprises a perimeter wall defining a lumen extending between the first and second ends of the sight tube. A light pin assembly is provided for creating a point of light on a light tip in the lumen being viewable through the first end of the sight tube for aligning with a targe. The second end of the lumen of the sight tube is substantially entirely closed against light transmission therethrough for preventing light transmission through the second end of the sight tube.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The various objects and features of novelty which characterize the invention are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
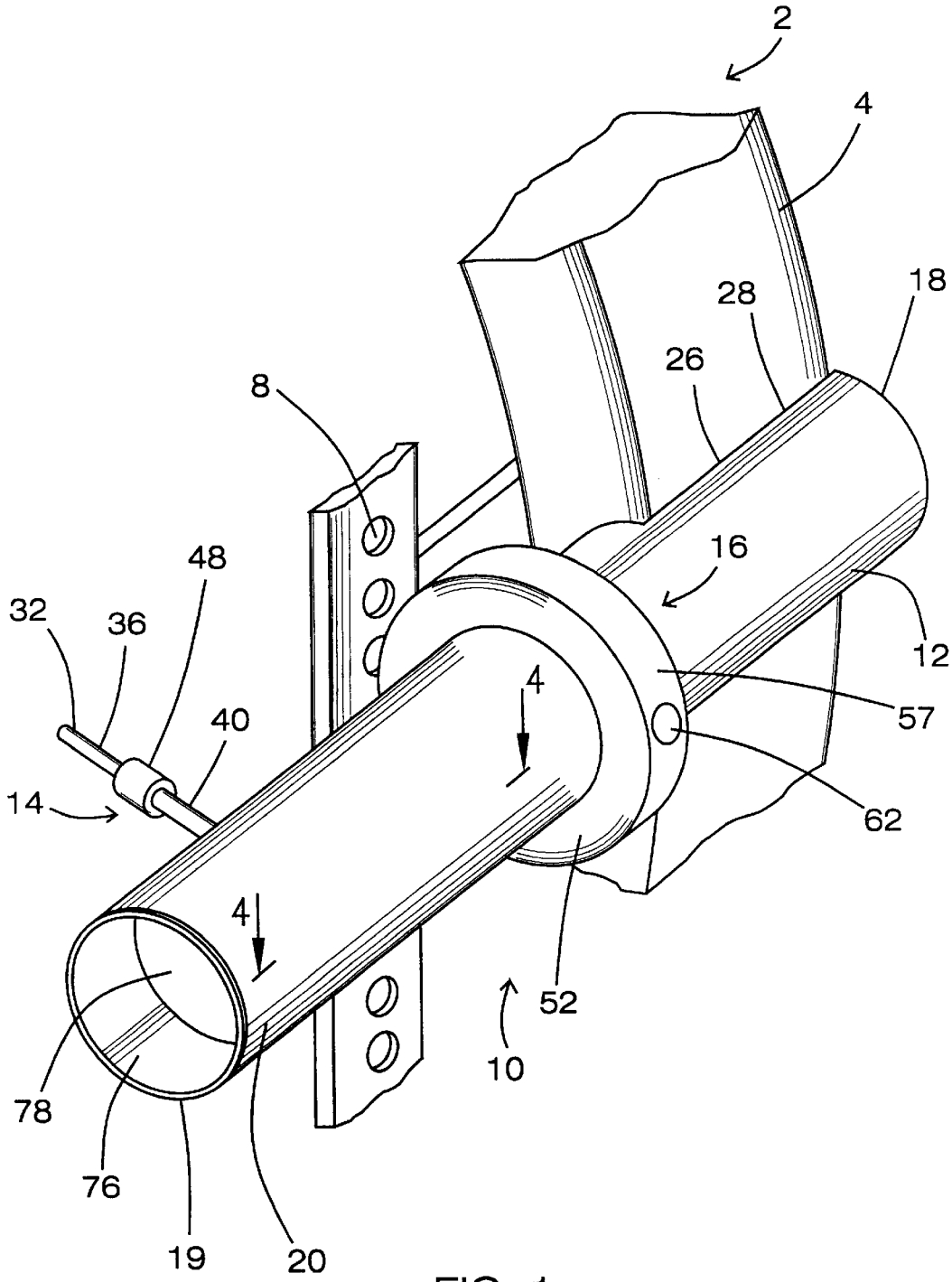
FIG. 1 is a schematic perspective view of a new archery bow sight according to the present invention mounted on a fragmentary portion of an archery bow.
Figure 2:
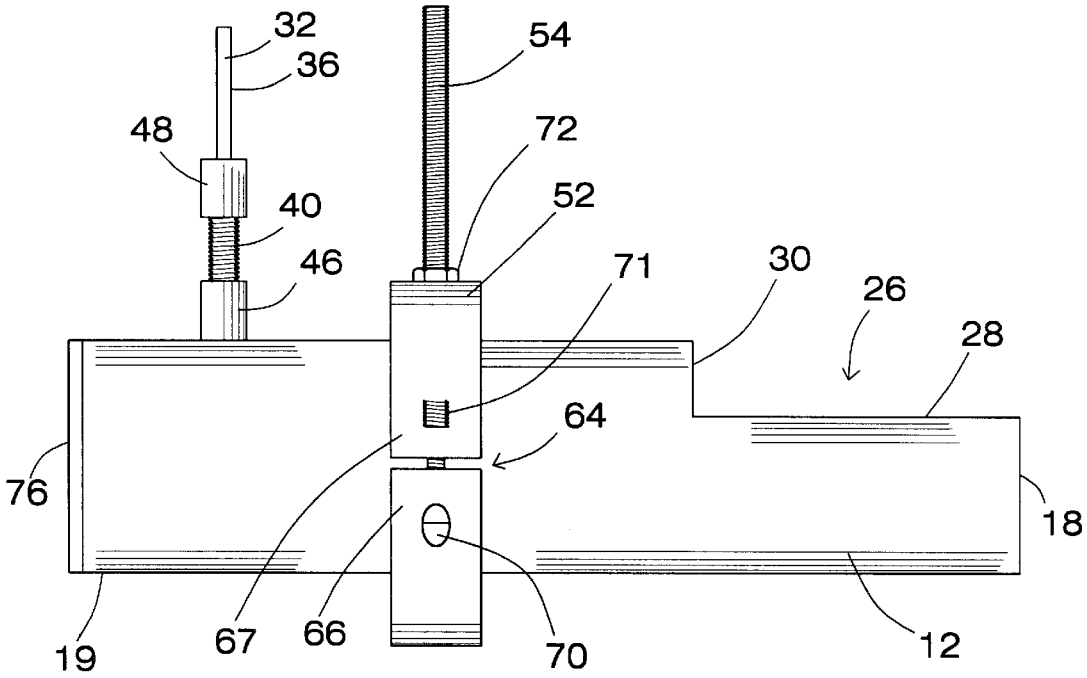
FIG. 2 is a schematic top view of the present invention.
Figure 3:
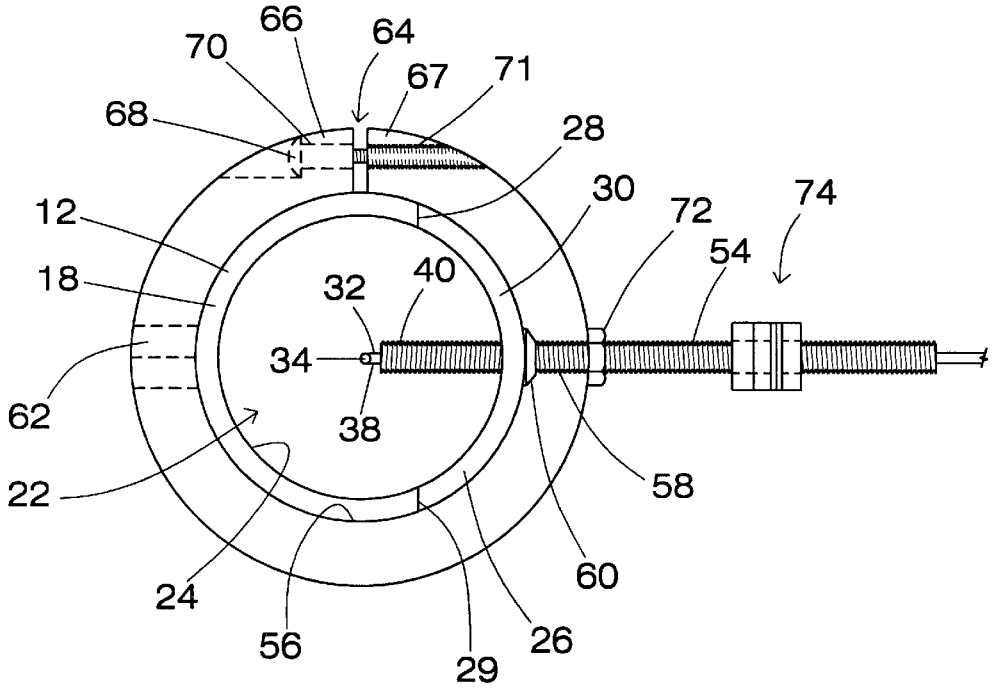
FIG. 3 is a schematic end view of the present invention taken from the first end of the sight tube.
Figure 4:
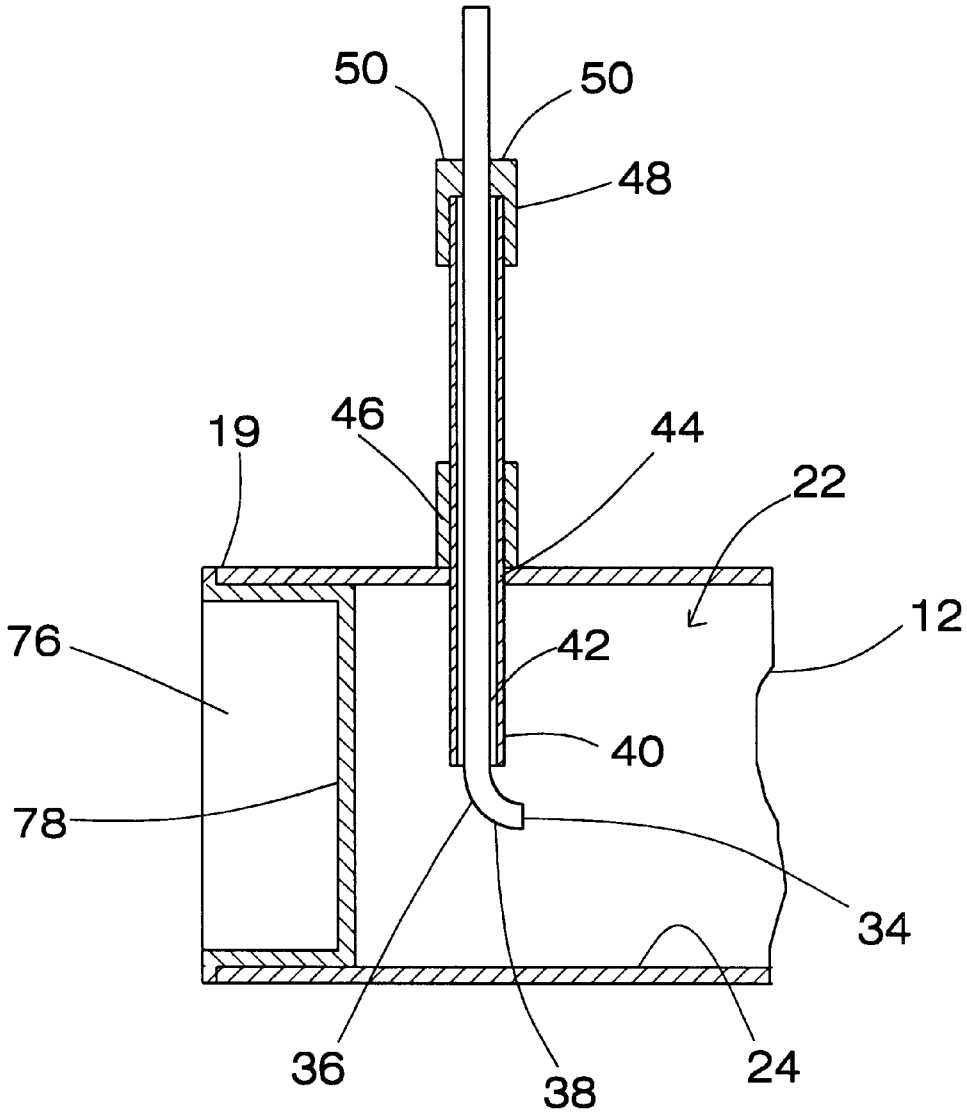
FIG. 4 is a schematic sectional view of a portion of the sight tube adjacent the second end of the sight tube indicated by line 4—4 in FIG. 1.
Figure 5:
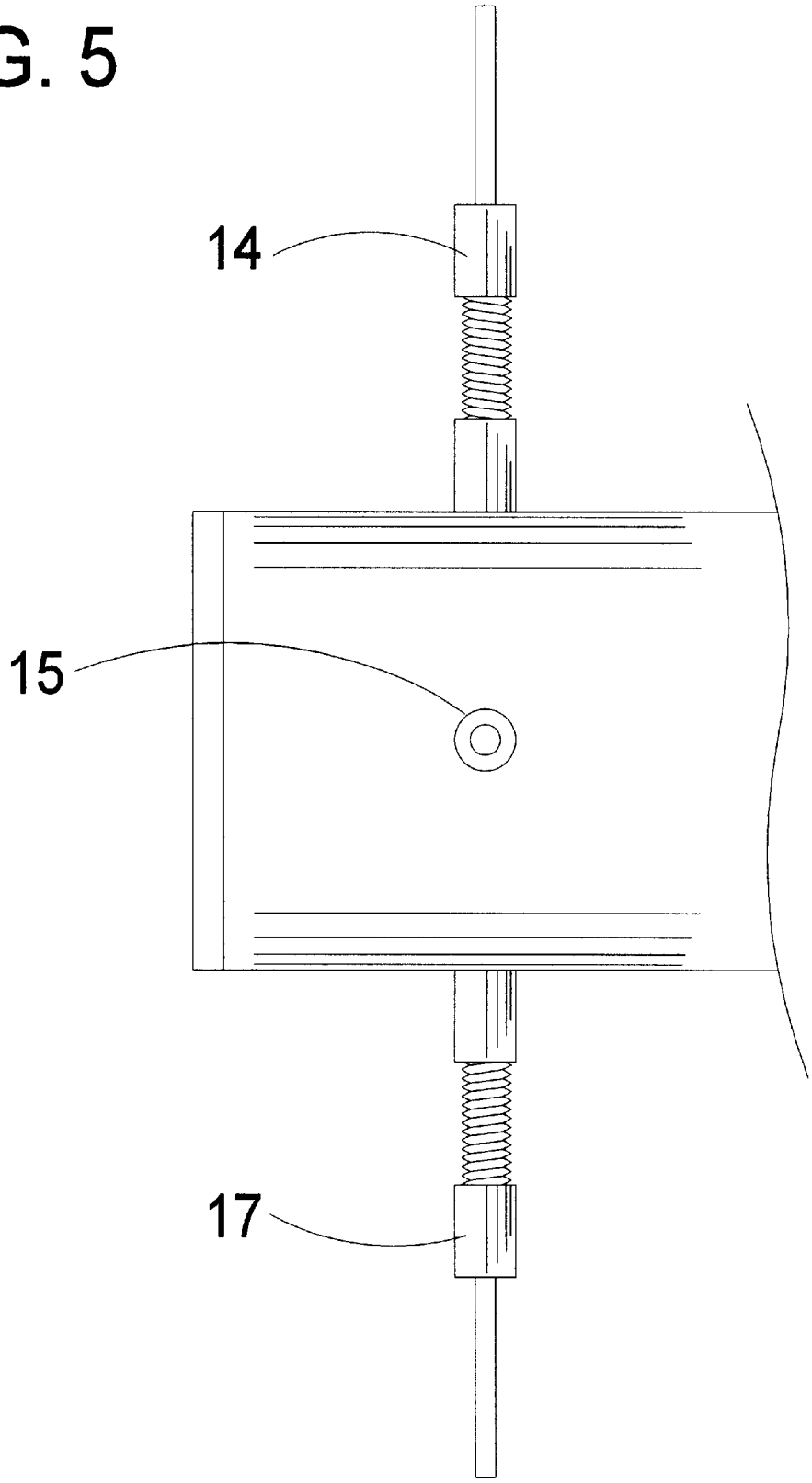
FIG. 5 is a schematic side view of the second end portion of the present invention showing the optional second and third light pin assemblies with respect to the first light pin assembly.

With reference now to the drawings, and in particular to FIGS. 1 through 4 thereof, a new archery bow sight embodying the principles and concepts of the present invention and generally designated by the reference numeral 10 will be described.

As best illustrated in FIGS. 1 through 4, the archery bow sight 10 of the invention generally comprises a sight tube 12, a light pin assembly 14, and a mounting assembly 16.

The archery bow sight 10 of the invention is suitable for mounting on an archery bow 2 of the type having a frame 4 for tensioning a bowstring. The frame 2 has a grip portion (not shown) for gripping by the hand of a user of the archery bow, and a mounting hole 8 in the bow (or structure associated with the bow) for receiving a sight mounting shaft for mounting the sight.

The sight tube of the archery bow sight of the invention is provided for viewing into by the dominant eye of the user of the archery bow during targeting of the bow. The sight tube is generally elongate, and has a first end 18 and a second end 19. The first end 18 of the sight tube is oriented toward the user and the second end 19 of the sight tube is oriented toward the target during targeting of the bow. The preferred sight tube comprises a perimeter wall 20 that defines a lumen 22 extending between the first 18 and second 19 ends of the sight tube. The interior 24 of the perimeter wall preferably comprises a dark surface for enhancing the contrast between the light pin and the lumen of the sight tube, and ideally, the surface is black. The perimeter wall of the sight tube preferably has an annular cross-section.

A notch 26 may be formed in the sight tube 12 for providing clearance space for the riser of the frame 4 of the archery bow when the sight tube is mounted on the bow. The notch 26 extends from the first end 18 of the sight tube toward the second end 19 of the sight tube. A pair of notch side edges 28, 29 extend longitudinally along the perimeter wall of the sight tube at circumferentially separated locations, and in a substantially parallel relationship. A notch end edge 30 extends between the notch side edges in a substantially parallel orientation to the first end of the sight tube.

The light pin assembly 14 is provided to create a point of light in the lumen that is viewable through the first end 18 of the sight tube for aligning with the target. The light pin assembly is most suitably mounted on the sight tube.

The light pin assembly includes a light pin 32 that extends into the lumen of the sight tube. The light pin 32 terminates in a light tip 34 positioned in the lumen of the sight tube, and the light tip radiates light therefrom for providing a distinct point of light in the lumen. The light pin is preferably positioned toward the second end of the sight tube. The light pin has a first portion 36 extending substantially perpendicular to the longitudinal axis of the lumen of the sight tube, and a second portion 38 of the light pin extends substantially parallel to the longitudinal axis of the lumen of the sight tube. The light tip 32 is located on the second portion 38 of the light pin with the light tip being oriented toward the first end 18 of the sight tube for viewing by the user. The light pin 32 may be mounted on the perimeter wall 20 of the sight tube, and the light pin 32 may pass through the perimeter wall of the sight tube from a location outside of the sight tube. The light pin 32 is preferably formed of a light transmitting material (such as, for example, fiber optic material) that is capable of transmitting ambient light from the exterior of the sight tube to the light tip 34 in the lumen 22 of the sight tube. Optionally, an artificial light source (not shown) may be provided in communication with an exterior location of the first portion of the light pin for illuminating the light tip in low ambient light conditions.

The light pin assembly 14 preferably further includes a securing conduit 40 for securing the light pin on the sight tube. The securing conduit 40 has a passage 42 that extend between the ends of the securing conduit, and the light pin 32 extends through the passage. The securing conduit 40 extends through a pin aperture 44 in the perimeter wall of the sight tube. The pin aperture 44 may be internally threaded, and the securing conduit 40 may have a threaded exterior surface for threadedly mounting the conduit in the pin aperture. The securing conduit, and the light pin mounted therein, may be selectively advanced into and withdrawn from the interior of the lumen of the sight tube for adjusting the position of the light tip to a particular target situation.

The light pin assembly further includes a locking collar 46 mounted on the securing conduit for securing the securing conduit 40 in position in the pin aperture 44. The locking collar 46 is threadedly mounted on the securing conduit for permitting the locking collar to be selectively abutted against the exterior of the perimeter wall of the sight tube. Preferably, the pin aperture 44 is centered on the notch 26 for causing the light pin assembly to extend from the side of the sight tube adjacent the bow frame when the sight is mounted on the bow frame. The combination of the threading of the securing conduit 40, the pin aperture 44, and the locking collar 46 together permits the parts to be secured so that the securing conduit is resisted against unintentional rotation with respect to the pin aperture, which could affect the position and orientation of the light tip in the lumen, while still permitting purposeful adjustment of the position of the light tip in the lumen.

The light pin assembly 14 also includes a pin securing collar 48 for securing the position of the light pin in the passage of the securing conduit. The pin securing collar 48 is mounted on one of the ends of the securing conduit. The pin securing collar 48 has a plurality of radially inward extending fingers 50 for frictionally engaging a portion of the light pin 32 to resist longitudinal movement of the light pin with respect to the pin securing collar and the securing conduit. The pin securing collar 48 is threadedly mounted on the securing conduit 40.

The mounting assembly 16 of the invention is provided for mounting the sight tube on the frame of the archery bow. The mounting assembly generally includes a mounting ring 52 and a mounting shaft 54. The mounting ring 52 is provided for embracing a portion of the sight tube 12 between the first 18 and second 19 ends. The mounting ring 52 may have an inner surface 56 for abutting against the exterior of the sight tube, and may have an outer surface 57.

A mounting hole 58 extends in a radial direction through the mounting ring between the inner 56 and outer 57 surfaces of the mounting ring. The mounting hole is provided for receiving the mounting shaft 54. A conical countersink recess 60 may be formed in the mounting hole at the inner surface of the mounting ring for accepting a head portion of the mounting shaft. An interior surface of the mounting hole may also have internal threads formed thereon for engaging threads on the mounting shaft.

An access hole 62 may be extended through the mounting ring for providing access to the mounting hole through the ring. The access hole is axially aligned with the mounting hole for permitting the mounting shaft (such as, for example, a threaded fastener) to pass through the access hole and into the mounting hole.

Preferably, the mounting ring has a gap 64 formed therein that is defined by a pair of ends 66, 67 on the mounting ring. The gap permits the circumference of the mounting ring to be reduced for selectively gripping the exterior of the sight tube. A tensioning fastener 68 extends between the pair of ends of the mounting ring for adjusting the distance of separation between the pair of ends for adjusting the compression exerted by the mounting ring on the sight tube for securing the ring on the tube. A passage 70, 71 extends into each of the ends of the pair of ends 66, 67, and the tensioning fastener 68 extends into each of the passages of the pair of ends. At least one of the passages 70, 71 is internally threaded so that rotation of the fastener advances the fastener in the passages for selectively bringing the ends together for constricting the diameter of the ring.

The mounting shaft 54 is provided for mounting the mounting ring to the frame of the archery bow. The mounting shaft extends through the mounting hole in the mounting ring. A portion of the exterior of the mounting shaft is threaded, and a nut 72 is threaded on the mounting shaft and abutted against the outer surface of the mounting ring. The mounting shaft is preferably a threaded fastener, with a head portion that is located adjacent to the inner surface of the mounting ring, preferably in the countersink recess. A plurality 74 of nuts may be threaded on the mounting shaft for securing the mounting shaft in position on the frame of the archery bow. The sight tube may be selectively pivoted on the mounting shaft with respect to the archery bow frame for adjusting the aiming of the sight tube.

Significantly, the second end of the lumen of the sight tube is substantially entirely closed against light transmission for preventing light transmission through the second end and into the lumen of the sight tube. Thus, the target cannot be viewed through the lumen of the sight tube, and the user cannot directly align the light tip with the target through the lumen of the sight tube using the dominant eye alone. Preferably, a cap 76 is mounted on the second end of the sight tube for closing the second end of the sight tube. The cap may have a cover wall 78 that is located in the lumen a distance away from the second end toward the first end.

Optionally, at least two light pin assemblies may be mounted on the sight tube for simultaneously providing multiple light tips as targeting points. A first one 14 of the light pin assemblies may have a longitudinal axis that is oriented at an angle of approximately 90 degrees with respect to a longitudinal axis of a second one 15 of the light pin assemblies. As a further option, a third light pin assembly 17 is mounted on the sight tube, and the third light pin assembly has a longitudinal axis that is oriented at an angle of approximately 90 degrees with respect to the longitudinal axis of one of the first and second light pin assemblies.

The archery bow sight of the invention is suitable for use by those persons whose dominant eye and dominant hand are located on the same side of the body. Thus, a user should determine which of his or her eyes is dominant and which is sub-dominant prior to use of the sight. One suitable and highly effective method of using the sight of the invention will now be described. The sight tube of the invention is positioned between the user and the target with the first end of the sight tube being directed toward the user and the second end of the sight tube being directed toward the target. The subdominant eye of the user is closed, and the dominant eye of the user is focused on the light tip of the light pin in the lumen of the sight tube. This act blocks the view of the target by the dominant eye of the user. The sub-dominant eye of the user is opened such that a view of the target by the sub-dominant eye is superimposed on a view of the light tip by the dominant eye. The view of the light tip by the dominant eye is aligned with the view of the target by the sub-dominant eye.

In one illustrative embodiment of the invention, the perimeter wall of the sight tube has a length of approximately 7 inches and a diameter of approximately 1.5 inches. The notch in the perimeter wall of the sight tube has a length of approximately 2⅛ inches, and extends into the perimeter wall approximately one half inch measured along a diameter of the lumen of the sight tube. The light pin assembly is located approximately 1⅛ inches from the second end of the sight tube.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An archery bow sight for mounting on an archery bow comprising:

a sight tube for viewing into by the dominant eye of the user, the sight tube being elongate with a first end for orienting toward a user and a second end being for orienting toward a target, the sight tube comprising a perimeter wall defining a lumen extending between the first and second ends of the sight tube; and a light pin assembly for creating a point of light on a light tip in the lumen being viewable through the first end of the sight tube for aligning with a target;

wherein the second end of the lumen of the sight tube is substantially entirely closed against light transmission therethrough for preventing light transmission through the second end of the sight tube.

2. The archery bow sight of claim 1 additionally comprising a cap being mounted on the second end of the sight tube for closing the second end of the sight tube.

3. The archery bow sight of claim 1 additionally comprising a second light pin assembly mounted on the sight tube for simultaneously providing multiple points of light in the lumen of the sight tube.

4. The archery bow sight of claim 3 wherein a first one of the light pin assemblies has a longitudinal axis that is oriented at an angle of approximately 90 degrees with respect to a longitudinal axis of the second light pin assembly.

5. The archery bow sight of claim 3 additionally comprising a third light pin assembly being mounted on the sight tube, the third light pin assembly having a longitudinal axis oriented at an angle of approximately 90 degrees with respect to the longitudinal axis of one of the first and second light pin assemblies.

6. The archery bow sight of claim 1 wherein the light pin assembly comprises a light pin extending into the lumen of the sight tube, the light pin terminating in the light tip and being positioned in the lumen of the sight tube, the light pin being formed of a light transmitting material.

7. The archery bow sight of claim 6 wherein the light pin assembly includes a securing conduit for securing the light pin on the sight tube, the securing conduit having a passage extending between ends of the securing conduit, the light pin extending through the passage of the securing conduit.

8. The archery bow sight of claim 7 wherein the light pin assembly includes a locking collar mounted on the securing conduit for securing the securing conduit in position in the pin aperture, the locking collar being threadedly mounted on the securing conduit for permitting the securing collar to be selectively abutted against the exterior of the perimeter wall of the sight tube.

9. The archery bow sight of claim 7 wherein the light pin assembly includes a pin securing collar for securing the position of the light pin in the passage of the securing conduit, the pin securing collar being mounted on the securing conduit, the pin securing collar having a plurality of radially inward extending fingers for frictionally engaging a portion of the light pin to resist longitudinal movement of the light pin with respect to the pin securing collar and the securing conduit.

10. The archery bow sight of claim 1 additionally comprising a mounting assembly for mounting the sight tube on the frame of an archery bow, the mounting assembly including a mounting ring for embracing a portion of the sight tube between the first and second ends, the mounting ring having an inner surface for abutting against the exterior of the sight tube.

11. The archery bow sight of claim 10 wherein the mounting ring has a mounting hole extending in a radial direction through the mounting ring between the inner and outer surfaces of the mounting ring.

12. The archery bow sight of claim 11 wherein the mounting ring has an access hole extending through the mounting ring for providing access to the mounting hole through the ring, the access hole being axially aligned with the mounting hole for permitting a fastener to pass through the access hole into the mounting hole.

13. The archery bow sight of claim 11 wherein the mounting assembly includes a mounting shaft for mounting the mounting ring to the frame of the archery bow, the mounting shaft extending through the mounting hole in the mounting ring.

14. The archery bow sight of claim 10 wherein the mounting ring has a gap formed therein defined by a pair of ends on the mounting ring.

15. The archery bow sight of claim 14 wherein the mounting assembly additionally comprises a tensioning fastener extending between the pair of ends of the mounting ring for adjusting a distance between the pair of ends for adjusting the compression exerted by the mounting ring on the sight tube.

16. An archery bow sight for mounting on an archery bow comprising:

a sight tube for viewing into by the dominant eye of the user, the sight tube being elongate with a first end for orienting toward a user and a second end being for orienting toward a target, the sight tube comprising a perimeter wall defining a lumen extending between the first and second ends of the sight tube; and a light pin assembly for creating a point of light on a light tip in the lumen being viewable through the first end of the sight tube for aligning with a target;

wherein the second end of the lumen of the sight tube is substantially entirely closed against light transmission therethrough for preventing light transmission through the second end of the sight tube;

wherein a notch is formed in the sight tube for receiving a portion of the frame of the archery bow, the notch extending from the first end toward the second end of the sight tube.

17. The archery bow sight of claim 16 wherein the notch is defined by a pair of notch side edges extending longitudinally along the perimeter wall at circumferentially separated locations and a notch end edge extending between the notch side edges in a substantially parallel orientation to the end of the sight tube.

18. A method of aiming an archery bow, comprising:

providing an archery bow sight comprising a sight tube having a first end and a second, the sight tube comprising a perimeter wall defining a lumen extending between the first and second ends of the sight tube, and a light pin assembly for creating a point of light on a light tip in the lumen being viewable through the first end of the sight tube, wherein the second end of the lumen of the sight tube is substantially entirely closed against light transmission therethrough;

positioning the sight tube between a user and a target with the first end of the sight tube being directed toward the user and the second end of the sight tube being directed toward the target;

closing a subdominant eye of the user;

focusing a dominant eye of the user on the light tip in the lumen of the sight tube and thereby blocking viewing of the target by the dominant eye of the user;

opening the sub-dominant eye of the user such that a view of the target by the sub-dominant eye is superimposed on a view of the light tip by the dominant eye; and aligning the view of the light tip by the dominant eye with the view of the target by the sub-dominant eye.

19. An archery bow sight for mounting on an archery bow having a frame and a mounting hole in the frame for receiving a sight mounting shaft, the archery bow sight comprising:

a sight tube for viewing into by the dominant eye of the user, the sight tube being elongate, the sight tube having a first end and a second end, the first end being for orienting toward the user and the second end being for orienting toward a target, the sight tube comprising a perimeter wall defining a lumen extending between the first and second ends of the sight tube, the perimeter wall of the sight tube having an annular cross-section;

a notch being formed in the sight tube for receiving a portion of the frame of the archery bow, the notch extending from the first end toward the second end of the sight tube, a pair of notch side edges extending longitudinally along the perimeter wall at circumferentially separated locations, a notch end edge extending between the notch side edges in a substantially parallel orientation to the end of the sight tube;

a light pin assembly for creating a point of light in the lumen viewable through the first end of the sight tube for aligning with a target, the light pin assembly being mounted on the sight tube, the light pin assembly comprising:

a light pin extending into the lumen of the sight tube, the light pin terminating in a light tip positioned in the lumen of the sight tube, the light pin having a first portion extending substantially perpendicular to the longitudinal axis of the lumen of the sight tube and a second portion extending substantially parallel to the longitudinal axis of the lumen of the sight tube, the light tip being located on the second portion of the light pin with the light tip being oriented toward the first end of the sight tube, the light pin being formed of a light transmitting material, wherein the light pin passes through the perimeter wall of the sight tube from a location outside of the sight tube;

a securing conduit for securing the light pin on the sight tube, the securing conduit having a passage extending between ends of the securing conduit, the light pin extending through the passage of the securing conduit, the securing conduit extending through a pin aperture in the perimeter wall of the sight tube;

a locking collar mounted on the securing conduit for securing the securing conduit in position in the pin aperture, the locking collar being threadedly mounted on the securing conduit for permitting the securing collar to be selectively abutted against the exterior of the perimeter wall of the sight tube;

a pin securing collar for securing the position of the light pin in the passage of the securing conduit, the pin securing collar being mounted on the securing conduit, the pin securing collar having a plurality of radially inward extending fingers for frictionally engaging a portion of the light pin to resist longitudinal movement of the light pin with respect to the pin securing collar and the securing conduit; and a mounting assembly for mounting the sight tube on the frame of the archery bow, the mounting assembly comprising:

a mounting ring for embracing a portion of the sight tube between the first and second ends, the mounting ring having an inner surface for abutting against the exterior of the sight tube;

a mounting hole extending in a radial direction through the mounting ring between the inner and outer surfaces of the mounting ring, a conical countersink recess being formed in the mounting hole at the inner surface of the mounting ring, an interior surface of the mounting hole having internal threads formed thereon;

wherein the mounting ring has a gap formed therein defined by a pair of ends on the mounting ring;

a tensioning fastener extending between the pair of ends of the mounting ring for adjusting a distance between the pair of ends for adjusting the compression exerted by the mounting ring on the sight tube; and a mounting shaft for mounting the mounting ring to the frame of the archery bow, the mounting shaft extending through the mounting hole in the mounting ring, a portion of the exterior of the mounting shaft being threaded;

wherein the second end of the lumen of the sight tube is substantially entirely closed against light transmission therethrough for preventing light transmission through the second end of the sight tube, a cap being mounted on the second end of the sight tube for closing the second end of the sight tube.

20. The archery bow sight of claim 19 additionally comprising at least two light pin assemblies are mounted on the sight tube for simultaneously providing multiple targeting points, wherein a first one of the light pin assemblies has a longitudinal axis that is oriented at an angle of approximately 90 degrees with respect to a longitudinal axis of a second one of the light pin assemblies.

* * * * *